United States Patent [19]

Loveless

[11] Patent Number: 4,717,335

[45] Date of Patent: Jan. 5, 1988

[54] CHILD RESISTANT LIGHTER

[76] Inventor: Guy M. Loveless, 470 Hickory, Apt. 203, Westland, Mich. 48185

[21] Appl. No.: 901,422

[22] Filed: Aug. 28, 1986

[51] Int. Cl.[4] ..... F23Q 1/02

[52] U.S. Cl. ..... 431/277

[58] Field of Search ..... 431/276, 277, 273, 254

[56] References Cited

U.S. PATENT DOCUMENTS 1,090,714 3/1914 Holtzman et al. ..... 431/276

3,814,572 6/1974 Nitta ..... 431/276

*Primary Examiner*—Carroll B. Dority, Jr.

*Attorney, Agent, or Firm*—Charles W. Chandler

[57] ABSTRACT

A cigarette lighter, including a gas nozzle mounted on a housing, and a rotatable spark-producing wheel engaged with a flint to deliver a spark toward the gas nozzle. The wheel carries a structure which engages the flint-supporting structure in such a way as to limit the rotation of the wheel unless it is rotated in the opposite direction, such that a child playing with the lighter will encounter difficulty in producing a spark when the wheel is disposed so as to be nonrotatable in the direction in which it delivers a spark to the nozzle.

2 Claims, 4 Drawing Figures

CHILD RESISTANT LIGHTER

BACKGROUND OF THE INVENTION

This invention pertains to cigarette lighters comprising a housing having a gaseous fuel for producing a spark at a nozzle when a serrated wheel is rotated in contact with a flint to deliver a spark toward the nozzle, and more particularly to such a lighter in which the serrated wheel is limited in its range of rotation in the direction in which it delivers a spark toward the nozzle so as to make it difficult for a child to ignite the lighter.

Children occasionally create a fire when playing with cigarette lighters. All they have to do is to rotate the serrated wheel of a conventional lighter to ignite the fuel.

SUMMARY OF THE INVENTION

The broad purpose of the present invention is to provide a safer lighter in which the spark wheel has structure which engages the flint-supporting structure in such a manner that the spark wheel can be rotated only a limited distance in either direction.

Normally, the wheel is rotated in one direction to deliver a spark toward the nozzle. When it is rotated in the opposite direction, the spark is delivered away from the nozzle. The wheel has a sufficient range of travel that the user can create a light by rotating the wheel to produce a spark and then leave the wheel in abutment with the flint-supporting structure, so that the wheel cannot be further rotated in the ignition-producing direction.

If a child should attempt to rotate the wheel in the ignition-producing direction, it does not rotate. If he rotates it in the opposite direction, then the wheel produces a spark away from the nozzle.

Still further objects and advantages of the invention will become readily apparent to those skilled in the art to which the invention pertains upon reference to the following detailed description.

DESCRIPTION OF THE DRAWING

The description refers to the accompanying drawing in which like reference characters refer to like parts throughout the several views, and in which.

DESCRIPTION OF THE PREFERRED EMBODIMENT

Figure 1:
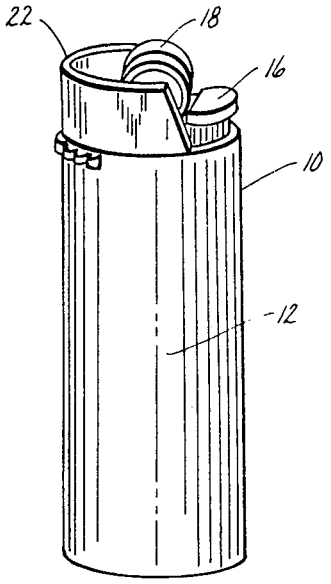
FIG. 1 is a perspective view of a lighter illustrating the preferred embodiment of the invention.
Figure 2:
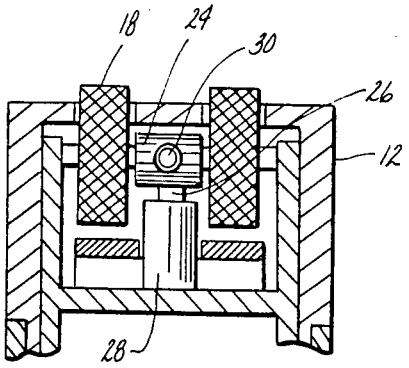
FIG. 2 is an enlarged sectional view of the spark wheel and the safety structure.

Referring to the drawing, FIG. 1 illustrates a discardable lighter 10 having housing 12 and a gas nozzle 14 for delivering gas when a push button actuated valve 16 is pressed toward the housing. A serrated, rotatable spark wheel 18, is mounted on pivot means 20 supported on the housing within a generally U-shaped flame-guard 22. The wheel has a serrted cylinder-shaped midsection 24 adapted to engage a flint element 26 supported in housing structure 28, as best illustrated in FIG. 2.

Figure 3:
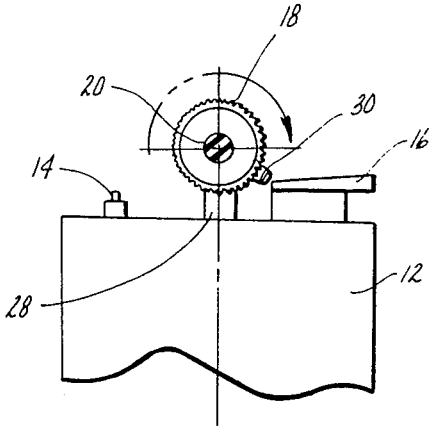
FIG. 3 is an elevational view with the flame guard removed to show the wheel being rotated in the ignition-producing direction.

The user normally holds the housing in his hand, rotates wheel 18 with his thumb in the clockwise direction, as viewed in FIG. 3, to produce a spark, while depressing valve 16 to allow gas to pass through nozzle 14. The spark ignites the gas. This is a relatively conventional structure for most cigarette lighters, including discardable lighters.

Figure 4:
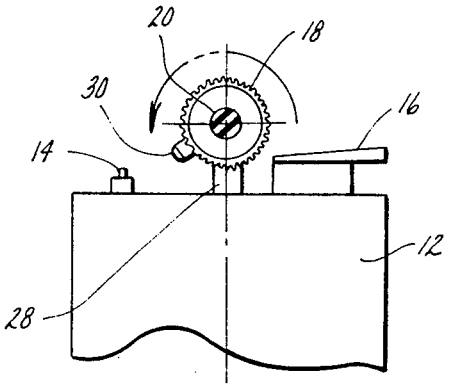
FIG. 4 is a view similar to FIG. 3, but with the wheel being rotated in the other direction.

Stop structure 30 is mounted on wheel 24 so as to be rotatable therewith and extends a sufficient distance from the serrated midsection 24 to engage structure 28, as viewed in FIG. 3, if the wheel is rotated in the clockwise direction to produce a spark. Stop structure 30 engages structure 28, thereby limiting the rotation of the wheel. The wheel can then be rotated in the clockwise direction only by first rotating the wheel in the opposite direction, as illustrated in FIG. 4. When being rotated in the opposite direction, as by a child, the spark-producing structure, comprising the wheel and the flint will deliver a spark in the opposite direction, that is, away from nozzle 14.

Thus, if the user upon igniting the lighter, leaves the wheel with structure 30 in abutment with structure 28, a child or other user cannot produce a ignition-producing spark by rotating the wheel in the clockwise direction, unless he first rotates it in the opposite direction. Thus, a child playing with a lighter, if he is able to rotate it in the opposite direction, will tend to be frustrated when he tries to produce an ignition producing spark because the spark is delivered in the wrong direction. If he attempts to rotate the wheel in the opposite direction, it will not rotate because structure 30 is in abutment with structure 28, thereby limiting the rotation of the wheel.

Having described my invention, I claim:

1. A gas lighter, comprising:

a housing for containing a fuel;

a gas nozzle mounted on the housing for discharging fuel therefrom;

a pushbutton-actuated valve mounted on the housing such that when depressed, the nozzle discharges the fuel;

a flint mounted on the housing between the nozzle and the pushbutton-actuated valve;

a spark-generating, serrated wheel mounted on the housing so as to be rotatable in a first direction when manipulated by the user to engage the flint to deliver a spark toward the fuel being discharged from the nozzle, the wheel being rotatable in the opposite direction;

first structure mounted on the wheel so as to be rotatable therewith along a path of motion between the flint and the pushbutton-actuated valve; and second structure mounted on the housing between the wheel and the housing to engage the first structure as the wheel is being rotated in said first direction to limit such rotational motion in the first direction, said second structure being operable to engage the first structure as the wheel is being rotated in the opposite direction to limit rotational motion in the opposite direction;

whereby the user cannot manipulate the wheel to rotate it in the first direction to deliver a spark toward the fuel after the first structure engages the second structure, unless the wheel is first manipulated in the opposite direction.

2. A gas lighter, comprising:

a housing for containing a fuel;

a nozzle mounted on the housing for discharging said fuel;

a flint mounted on the housing adjacent the nozzle;

a spark-generating, serrated wheel mounted on the housing to engage the flint, the wheel being rotatable by manipulation in a first direction for engaging the flint to generate and deliver a spark toward fuel being discharged from the nozzle to cause ignition of the fuel;

first structure mounted on the wheel so as to be rotatable therewith along a path of motion about the flint; and second structure mounted on the housing between the wheel and the housing adjacent said path of motion to engage the first structure as the wheel is being rotated in the first direction to limit such motion in the first direction, said second structure being operable to engage the first structure as the wheel is rotated in the opposite direction to limit motion thereof in the opposite direction;

whereby the user cannot manipulate the wheel to rotate it in the fiorst direction after the first structure engages the second structure unless the wheel is first manipulated in the opposite direction.

* * * * *